US007032247B2

(12) United States Patent
Frieswick et al.

(10) Patent No.: US 7,032,247 B2
(45) Date of Patent: Apr. 25, 2006

(54) BIB-GARMENT SYSTEM

(75) Inventors: Kevin Frieswick, 288 Firetown Rd., Simsbury, CT (US) 06070; Melissa Frieswick, Simsbury, CT (US)

(73) Assignee: Kevin Frieswick, Simsbury, CT (US)

( * ) Notice: Subject to any disclaimer, the term of this patent is extended or adjusted under 35 U.S.C. 154(b) by 202 days.

(21) Appl. No.: 10/830,681

(22) Filed: Apr. 23, 2004

(65) Prior Publication Data

US 2005/0241042 A1 Nov. 3, 2005

(51) Int. Cl.
*A41B 13/10* (2006.01)
*A41D 11/00* (2006.01)

(52) U.S. Cl. ..... 2/49.1; 2/52; 2/75; 2/80

(58) Field of Classification Search ..... 2/48, 2/49.1–49.5, 46, 47, 50, 51, 52, 70, 75, 80, 2/83, 92, 103, 107, 111, 119, 120, 114, 104, 2/121

See application file for complete search history.

(56) References Cited

U.S. PATENT DOCUMENTS

| | | | | | |
|---|---|---|---|---|---|
| 487,000 | A | * | 11/1892 | Auer | 2/115 |
| 540,756 | A | * | 6/1895 | ODell | 2/49.2 |
| 1,521,228 | A | * | 12/1924 | Clamage | 2/72 |
| 1,808,496 | A | * | 6/1931 | Dillon | 2/111 |
| 2,425,635 | A | * | 8/1947 | Nitzberg | 2/75 |
| 2,501,010 | A | * | 3/1950 | Seidenbaum | 2/48 |
| 2,556,039 | A | * | 6/1951 | Landert | 2/106 |
| 3,608,092 | A | | 9/1971 | Taranto | |
| 4,639,946 | A | | 2/1987 | Koenig | |
| 4,754,500 | A | * | 7/1988 | Brucato et al. | 2/105 |
| 5,146,626 | A | * | 9/1992 | Rosado | 2/105 |
| 5,153,940 | A | | 10/1992 | Bergquist | |
| 5,454,119 | A | * | 10/1995 | Thomm | 2/114 |
| 5,640,715 | A | * | 6/1997 | Adams | 2/46 |
| 5,893,171 | A | * | 4/1999 | Ries | 2/48 |
| 6,032,287 | A | | 3/2000 | Kallas | |
| 6,216,269 | B1 | | 4/2001 | Smith et al. | |
| 2003/0208828 | A1 | * | 11/2003 | Brooks | 2/49.1 |

* cited by examiner

*Primary Examiner*—Amy B. Vanatta
(74) *Attorney, Agent, or Firm*—B J Associates; Bolesh J. Skutnik

(57) ABSTRACT

A protective bib-garment system is described wherein a bib is detachable from the garment it protects, but can not rotate around the wearer's neckline. It thereby provides better protection and safety for the user. The bibs are easily attached or removed for separate cleaning when soiled. The danger of the user choking by having the bib rotate and tighten around the neck is generally removed. Better protection of the underlying garment is also achieved by keeping the bib anchored in front of the user. The system includes bib-ready garments in a wide range of styles, substantially any garment that could be worn by a bib user and is modified to accept the bib portion. These garments can be worn without the bibs and undergarments are protected from outside view or contact by the overlapping garment-bib interface attached to the inside surface of the garment. Temporarily or permanently incapacitated persons of any age who need help with feeding or to control drool can benefit from an appropriately sized embodiment of the invention.

10 Claims, 12 Drawing Sheets

BIB-GARMENT SYSTEM

BACKGROUND OF THE INVENTION

1. Field of the Invention

The present invention is directed to a bib-garment system, including a bib as a protective garment attachment, which will not rotate about a user's neck during use. In particular, it deals with non-rotating bibs to protect garments worn by small children or persons needing help during feeding.

2. Prior Art Statement

Most commonly bibs for children, which are removable, have tails or ends which encircle the child's neck and are tied or otherwise fastened behind the neck. Such bibs easily rotate as the child moves his or her head, diminishing the bib's primary purpose, which is to protect the garments on the child from food spillage, throw up or dribbling.

The bibs are usually worn when the infant child is eating, but since sometimes these children may throw up at night-time, a bib is often left on as the child is put down to sleep. In such use, movement of the bib as the child moves has potentially more harmful consequences, potentially choking a child if it gets caught on something or twists and tightens about the neck.

Seeing these potential problems several approaches have been taken to alleviate one or more of these problems. In one approach, bib garment systems or bib-restraining combinations for high chairs have been developed as exemplified in U.S. Pat. No. 3,608,092 (Taranto); U.S. Pat. No. 5,153,940 (Bergquist); and U.S. Pat. No. 4,639,946 (Koenig).

In Taranto and in Bergquist a bib like section is permanently attached to the garment. As stated in Taranto, the bib is integrated with the garment and is considered in effect an appliqué. The connections to the garment are quite extensive and complex. In Bergquist the bib is attached to a sleeper and has the zipper going through it as well as the garment. The attachment of the bib to the sleeper is extensive and complex. In both cases the garment and bib must be washed together, even if only the bib is soiled. The garment cannot be worn without the bib and thus is not suitable for many different occasions. The extensive coupling between bib and garment could even be an irritation to the child. These bibs do not move (rotate) in use but the problems outlined above severely limit the value of this solution.

Another version of a dedicated bib-garment system, incorporates a restraining feature as noted for Koenig. The restraining garment with detachable bib involves a design where the bib function is tied to the child wearing the restraining garment while in a high chair. The combination of bib and restraining garment protect the child's upper torso from food spillage or throw up. Employing a detachable bib improves upon the bib-garment one piece solutions, but the coupling with a restraining garment severely restricts the use of the system to children old enough to be in the high chair and only when they are there. Feeding without a high chair, or concerns about throw up during nap/sleep time, cannot be handled well by this device. Also it means that the restraining garment must be used to get the benefit of this 'improved' bib.

Another alternative solution has been the development of a garment system where the front panel is detachable and thus can be removed and replaced if it becomes soiled without the need to fully undress the child. In effect the front panel, which is made of absorbing materials, functions as a bib. To secure the panel across the whole front of the child requires several connecting means that must opened to remove or must be made before a new panel can be secured.

The underlying garment is only a partial, dedicated item, not protecting the child from the elements while the front panel is removed. Extra panels are needed to be carried around in order to be able to replace a panel should the original become soiled. Front panels must be compatible with the rest of the outfit, meaning either at least two or more front panels must be bought for each underlying garment or all have to be similar in color and style to permit cross attachment when necessary.

More recently, Smith et al. in U.S. Pat. No. 6,216,269 B1 describe a removable bib which is attached to an associated garment by matching five (5) hook and pile strips on bib and garment. The attachment sites follow the shape of the garment's neck line across its front.

SUMMARY AND OBJECTIVES OF THE INVENTION

It is an object of the present invention to provide a bib-garment system for a young child in which the bib portion cannot rotate about the child's neck in use and it is easily removable from the garment portion for replacement when soiled or not needed.

It is another object of the present invention to provide a protective bib-garment system which allows for a variety of specially adapted toddlers' garments that can be matched with a bib portion.

It is a further object of the present invention to provide a protective bib-garment system in which a bib can be attached to or removed from a child while they are lying down, without lifting the child's head and/or shoulders.

It is yet another object of the present invention to provide a protective bib-garment system which can equally be used to protect garments for elderly or incapacitated persons analogously as for small children.

It is still another object of the present invention to provide a protective bib-garment system where the garment portion can be worn without the bib portion.

Another object of the present invention is to provide a protective bib-garment system where the garment portion does not expose an undergarment at the bib attachment location, even with the bib portion removed.

Briefly stated in the present invention, a protective bib-garment system is described wherein a bib is detachable from the garment it protects, but can not rotate around the wearer's neckline. It thereby provides better protection and safety for the user. The bibs are easily attached or removed for separate cleaning when soiled. The danger of the user choking by having the bib rotate and tighten around the neck is generally removed. Better protection of the underlying garment is also achieved by keeping the bib anchored in front of the user. The system includes bib-ready garments in a wide range of styles, substantially any garment that could be worn by a bib user and is modified to accept the bib portion. These garments can be worn without the bibs and undergarments are protected from outside view or contact by the overlapping garment-bib interface attached to the inside surface of the garment. Temporarily or permanently incapacitated persons of any age who need help with feeding or to control drool can benefit from an appropriately sized embodiment of the invention.

The above, and other objects, features and advantages of the present invention will become apparent from the following description read in conjunction with the accompanying drawings, in which like reference numbers in different drawings denote like items.

DETAILED DESCRIPTION OF PREFERRED EMBODIMENTS

Described below are several of the preferred embodiments of the protective bib-garment system and its components. To illustrate various features of the system. Note the system can use any garment as a base, as long as the garment can be modified to have the precut openings properly spaced and where desired the garment-bib interface on the underside of the garment. Likewise the fasteners used on the bib portion of the system can be selected from any type which can have a mating ability that does not create contact to the user (child) which might lead to irritating the user. Preferred ones are those fasteners which can be closed the use of one hand while the caregiver holds/steadies the user of the bib-garment system.

Figure 1:
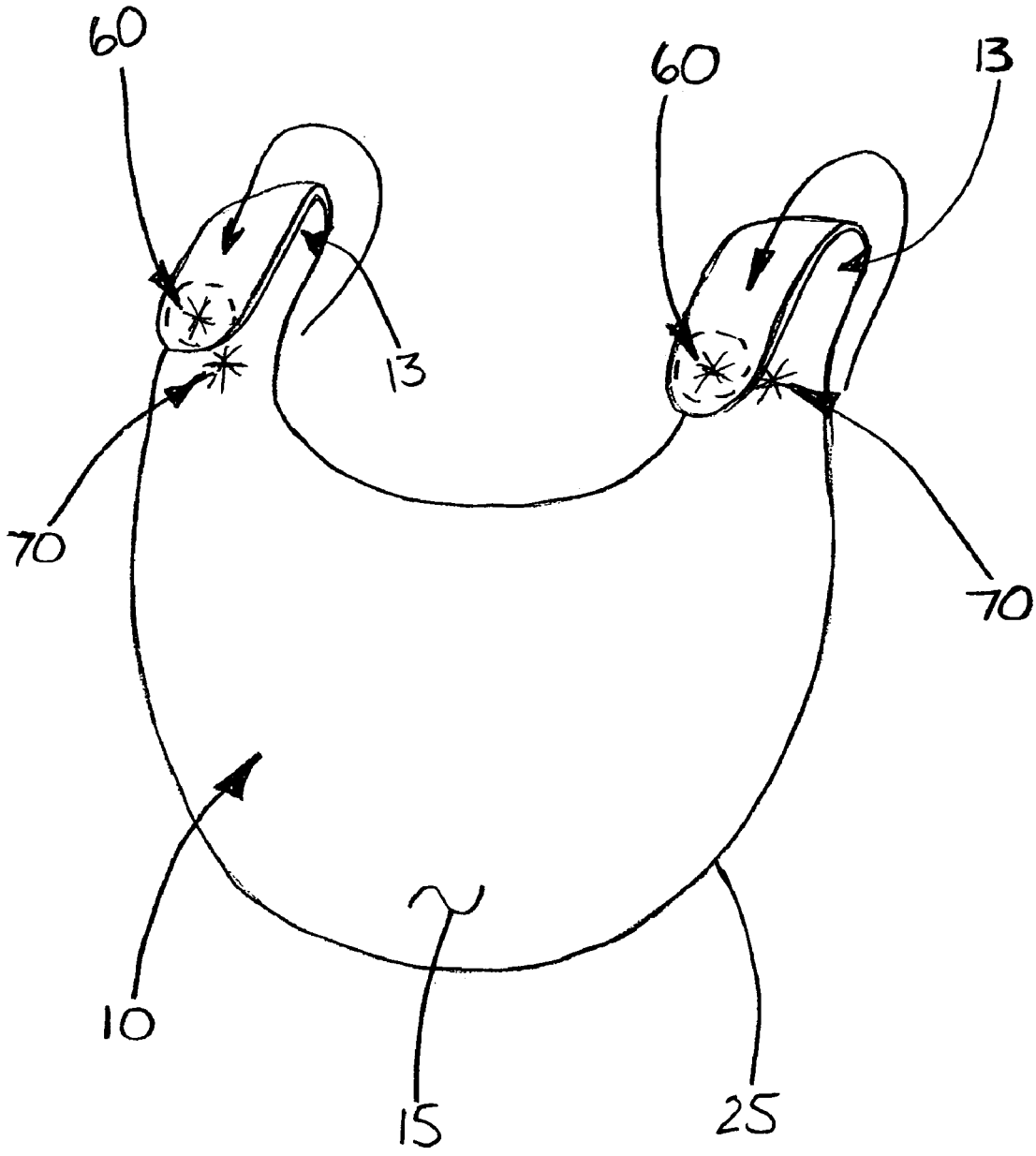
FIG. 1 shows a view of a preferred embodiment of a bib from the bib-garment system of the present invention

In FIG. 1 is presented a basic bib design including non-rotating bib portion 10, bib feed through strap 13, with 15 bib absorbent layer, 25 bib impermeable layer, 60 fastener A and 70 mating fastener B. In this figure, one can see the bib and how strap 13 overlaps onto item 10 to secure itself This two location overlapping fastening system accomplishes several things. First it holds the bib in place and keeps it from rotating around the next of the child. Secondly the fasteners reduce the likelihood that the bib will be pulled tight around the child's neck. Thirdly, this bib can be removed from a sleeping baby without lifting the baby's head and waking her.

Figure 2:
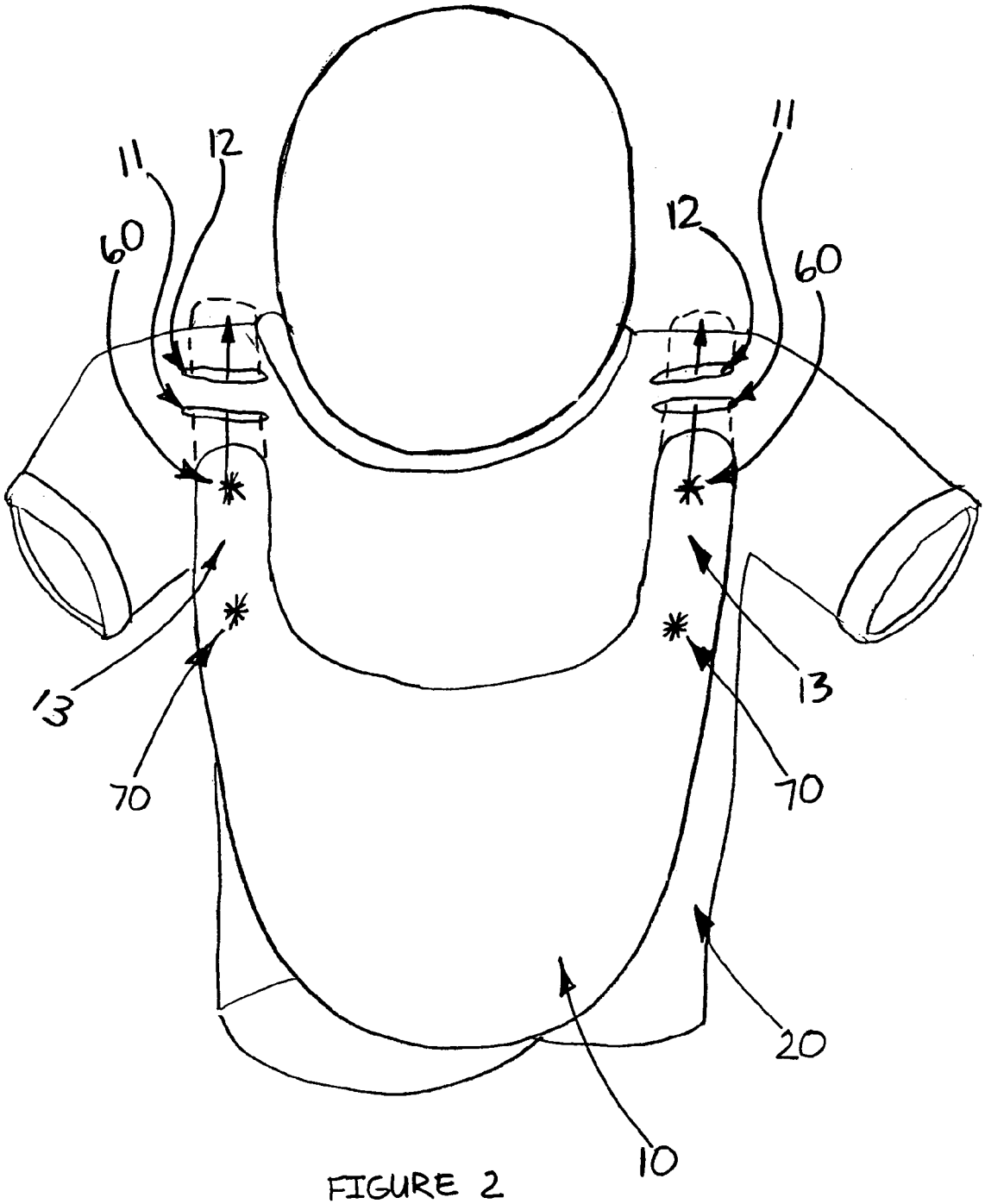
FIG. 2 shows a preferred embodiment of the present bib-garment system, with some detail as to how the bib portion can be attached to the garment portion.

In FIG. 2 bib portion 10, is shown together with garment portion 20, which has 11 garment lower precut opening, 12 garment upper precut opening. Bib feed through strap 13 has 60 fastener A and 70 mating fastener B. In this figure one can see bib portion 10 and how strap 13 inserts into the garment at opening 11 and exits the garment at opening 12. Also shown are the fastener locations for fastener 60 and mating fastener 70. This figure also demonstrates a second preferred embodiment wherein a second set of mating fasteners is set on bib portion 10 below a first set. These second fasteners 75 can be used to raise the bib relative to the garment, effectively shortening the broad section of the bib lying over the garment.

Figure 3:
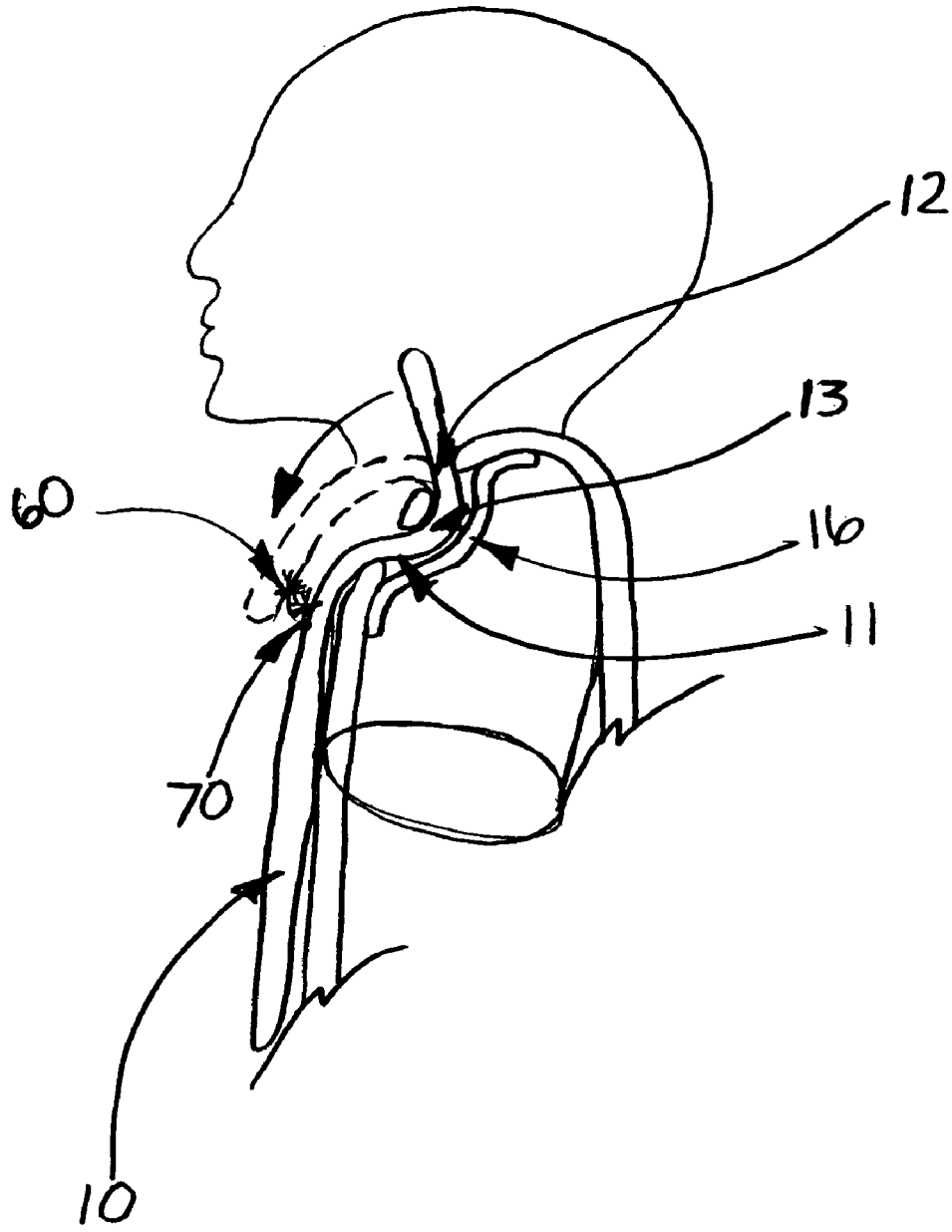
FIG. 3 illustrates a detailed cross section of a preferred embodiment of the present invention prior to the bib portion being fully fastened to the garment portion.

In FIG. 3 is shown in this figure is a cross sectional view of the bib and garment system cut through the nearest shoulder interface. Pictured is bib 10, and how it will rest on the garment and how strap 13 feeds through into the garment at lower opening 11 and exits the garment at upper opening 12. Also shown is garment-bib interface 16, depicting its location and purpose as it covers, from the inside of the garment, the area where the precut openings are placed. Lastly the location and purpose of fasteners 60 and 70, here depicted as a receptacle style fastener joined to a protrusion style fastener as they fasten strap 13 onto bib 10 and secure it in place is shown. Note that the presence of garment-bib interface 16 protects undergarment and child/wearer from direct exposure to the environment, providing for more comfort to wearer with or without bib being attached.

Figure 4:
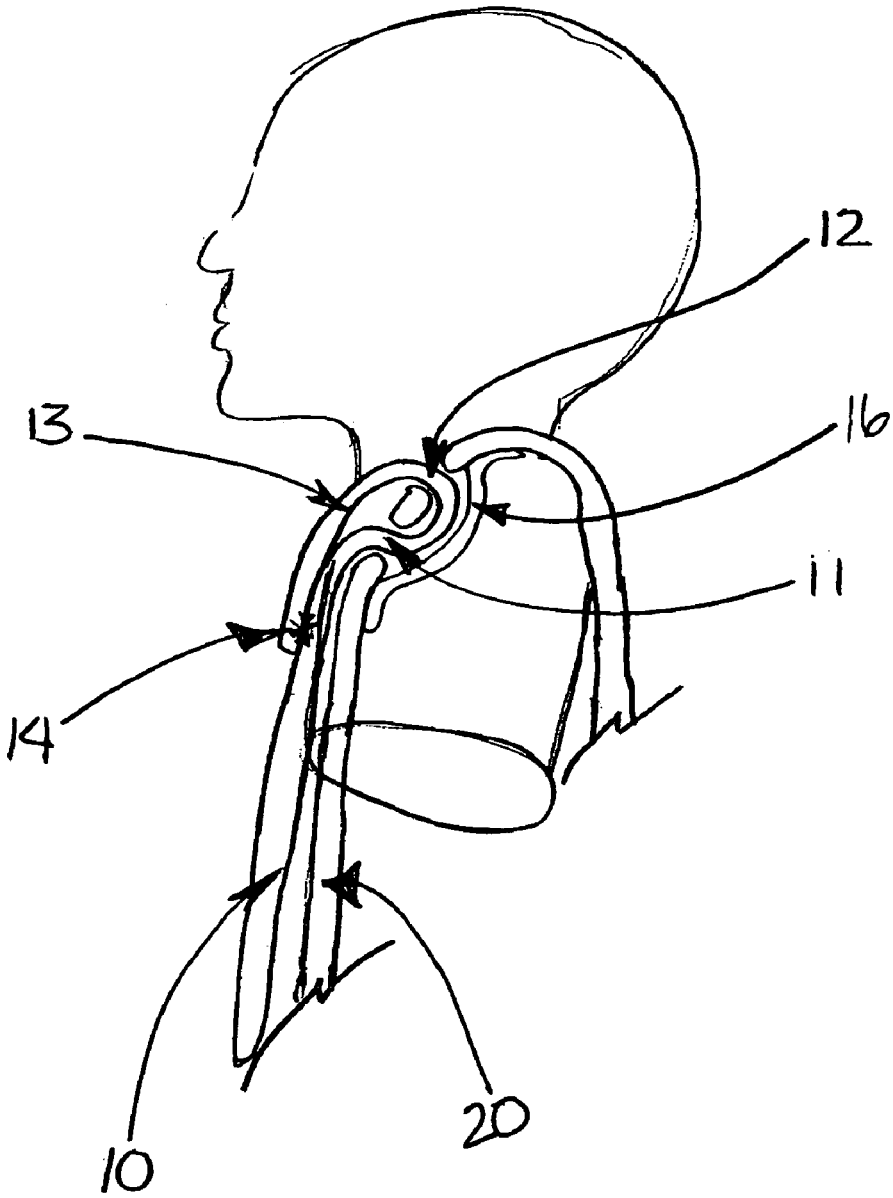
FIG. 4 illustrates a detailed cross section of a preferred embodiment of the present invention with the bib portion being fully fastened to the garment portion.

FIG. 4 is a cross sectional view of the bib and garment system cut through the nearest shoulder interface. Bib 10 is resting on garment 20 with strap 13 fed through lower opening 11 and out upper opening 12 and fastened onto bib 10 via the closed fastener 14.

Figure 5:
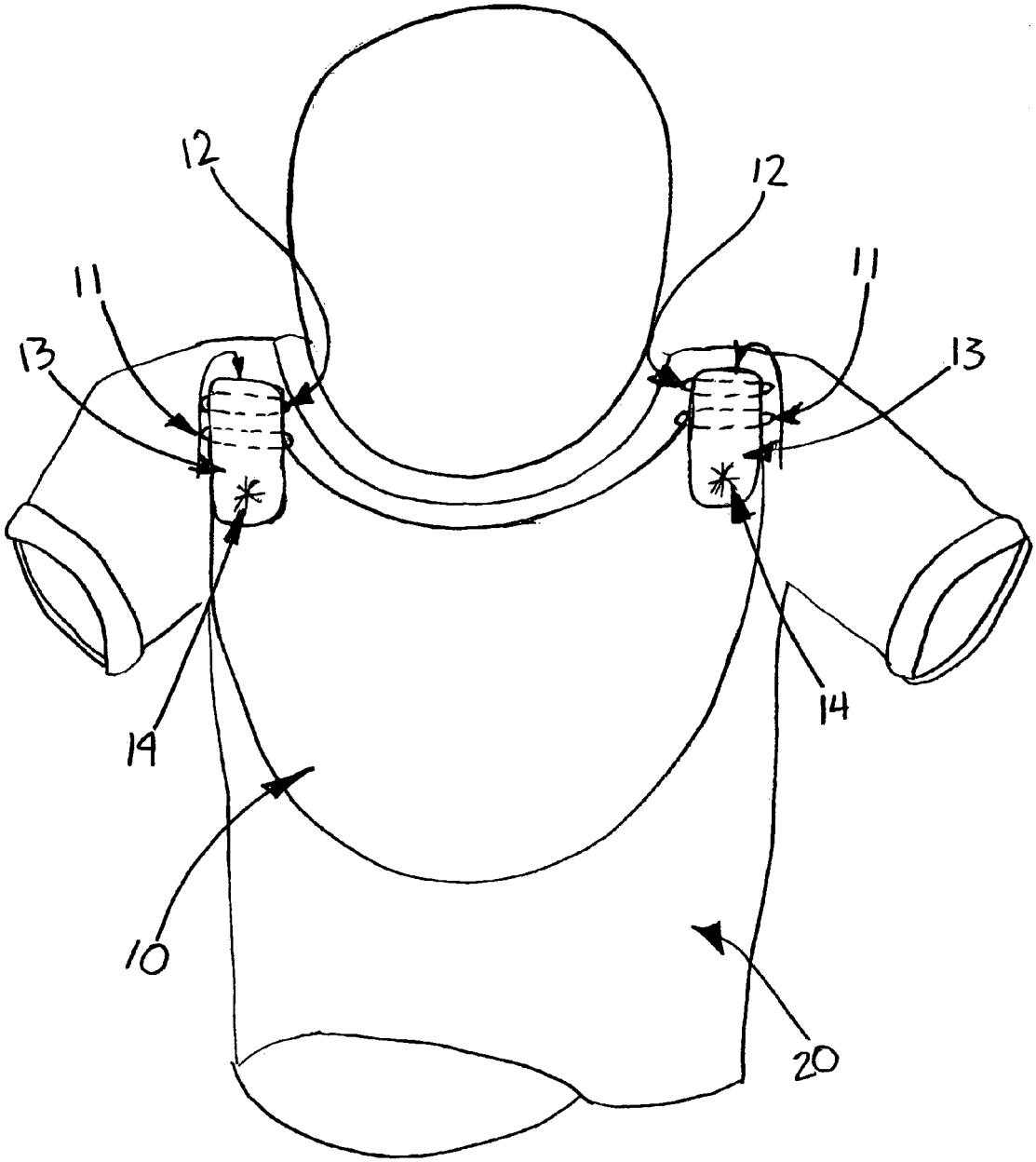
FIG. 5 shows a front view of a preferred embodiment of the bib-garment system of the present invention, fully fastened.
Figure 6:
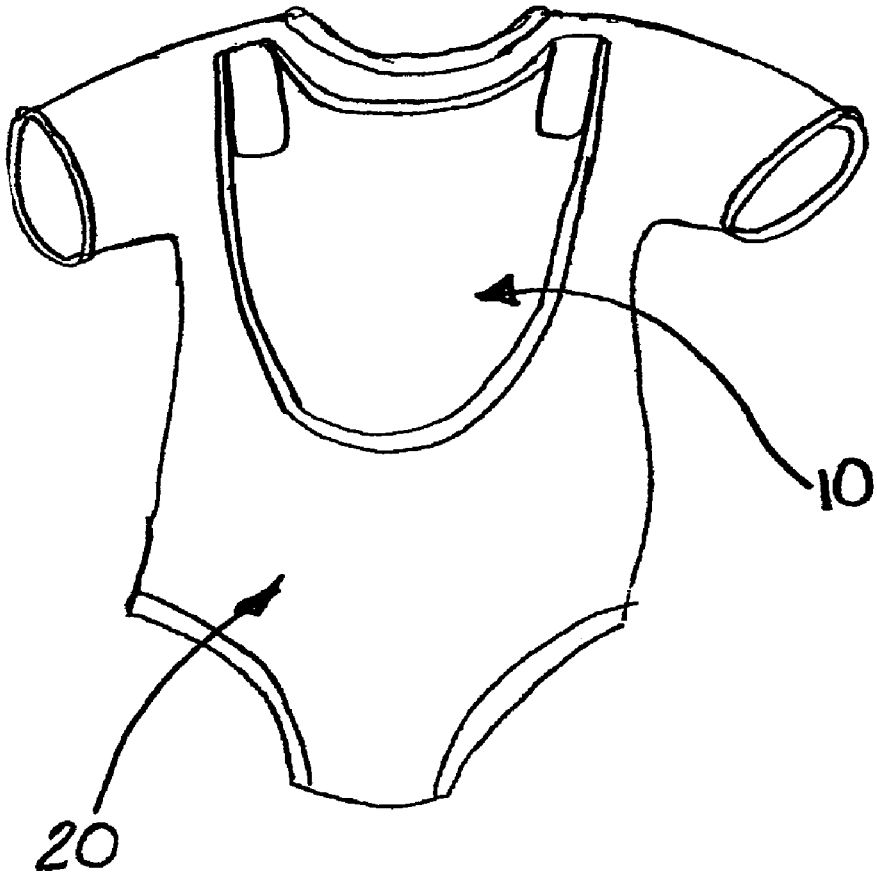
FIGS. 6 through 12 illustrate a series of preferred embodiments of the bib-garment system for a variety of garments with a fully attached bib portion.
Figure 7:
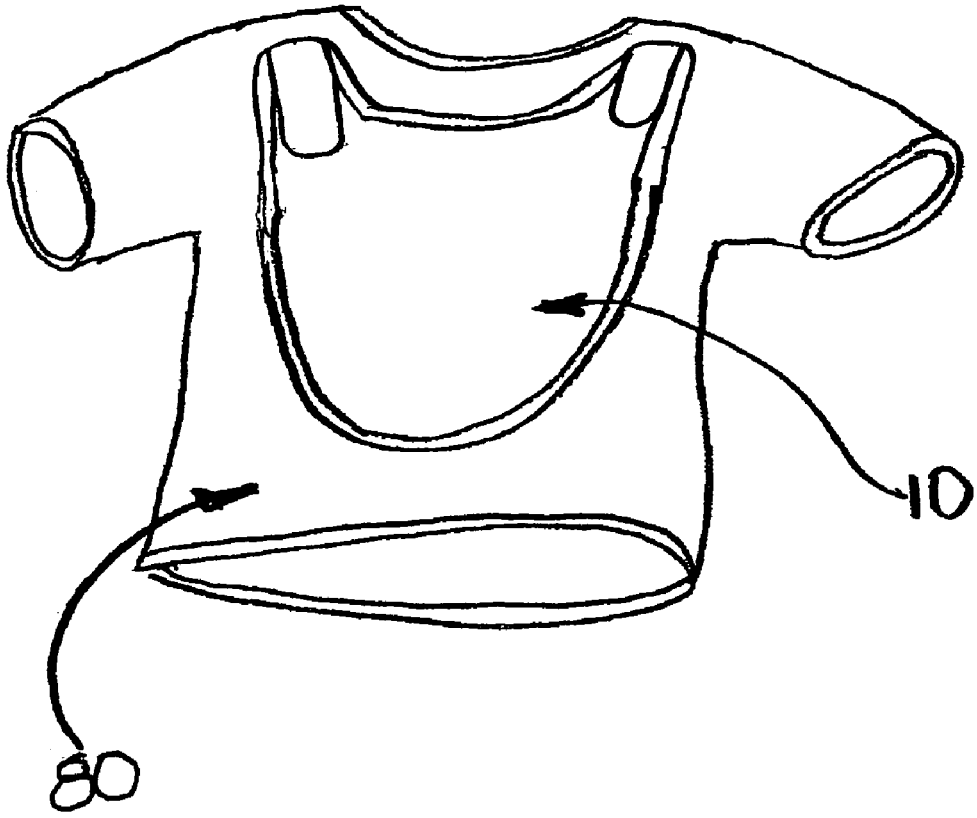
Figure 8:
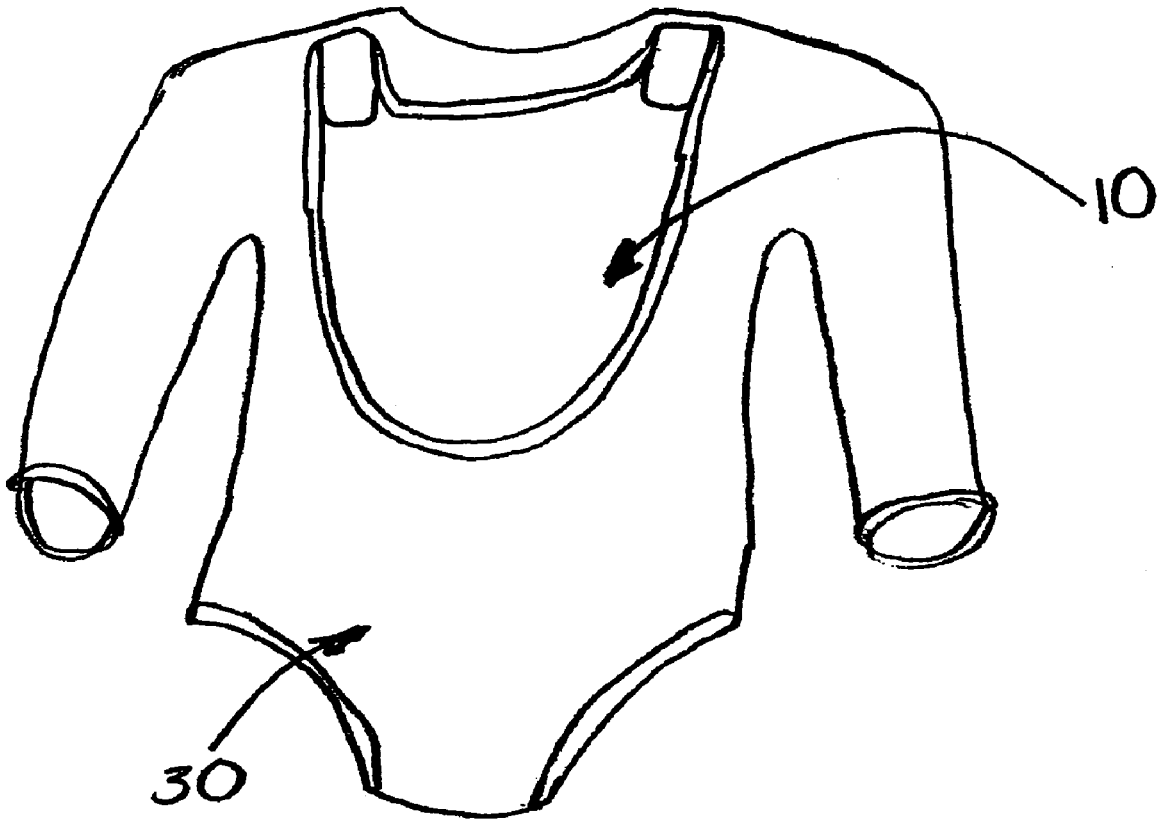

A front view of the protective bib-garment system is shown in FIG. 5, analogous to the cross-sectional view of the prior figure. Again bib 10 is resting on garment 20 with straps 13 fed through lower openings 11 and out upper openings 12, then overlapped and fastened onto bib 10 via the closed fastener 14. FIG. 6–12 provide details of the protective bib-garment system for a series of possible garments 20. In FIG. 6 garment 20 is a short sleeve no leg onsie. In a similar fashion the system is depicted in FIG. 8 with garment 30 being a long sleeve no leg onsie. FIG. 7 shows bib portion 10 on garment 80, being a short sleeve shirt.

Figure 9:
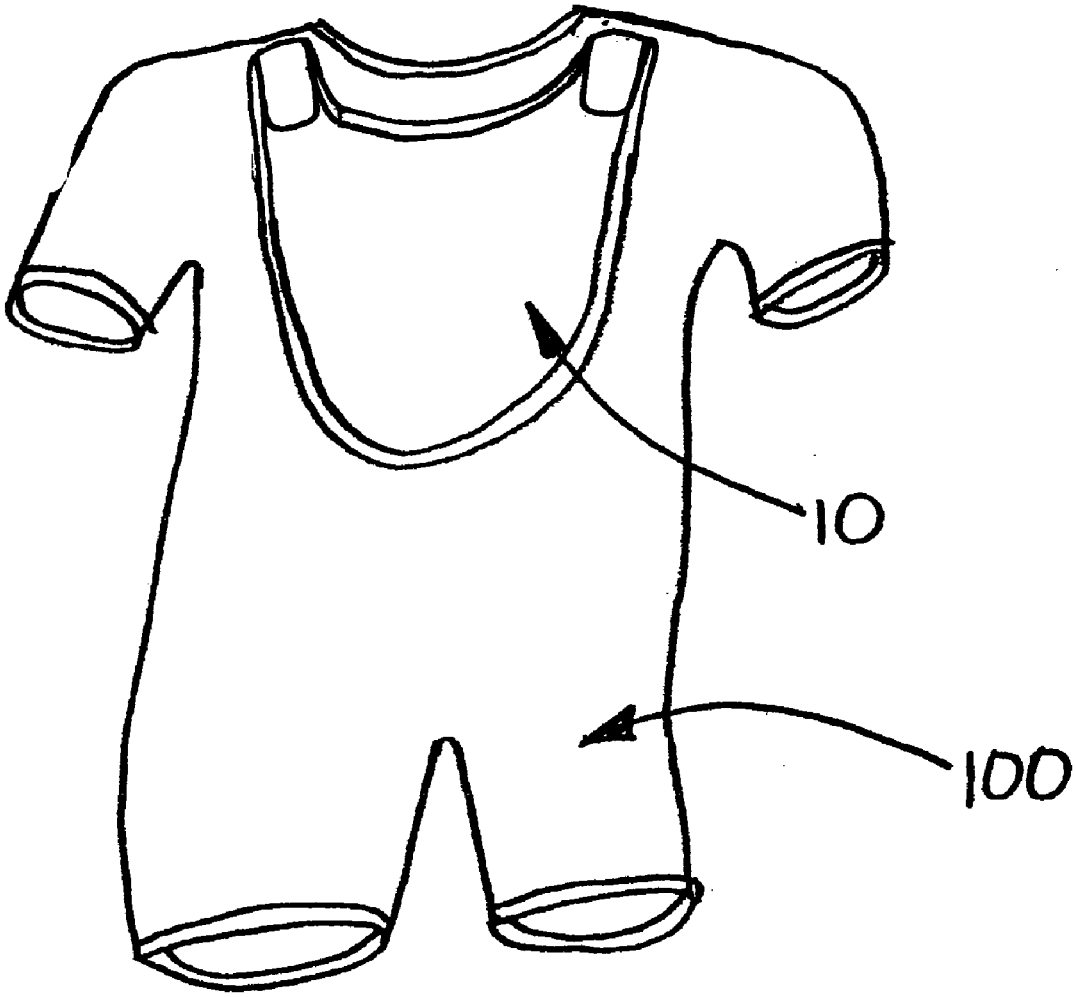
Figure 10:
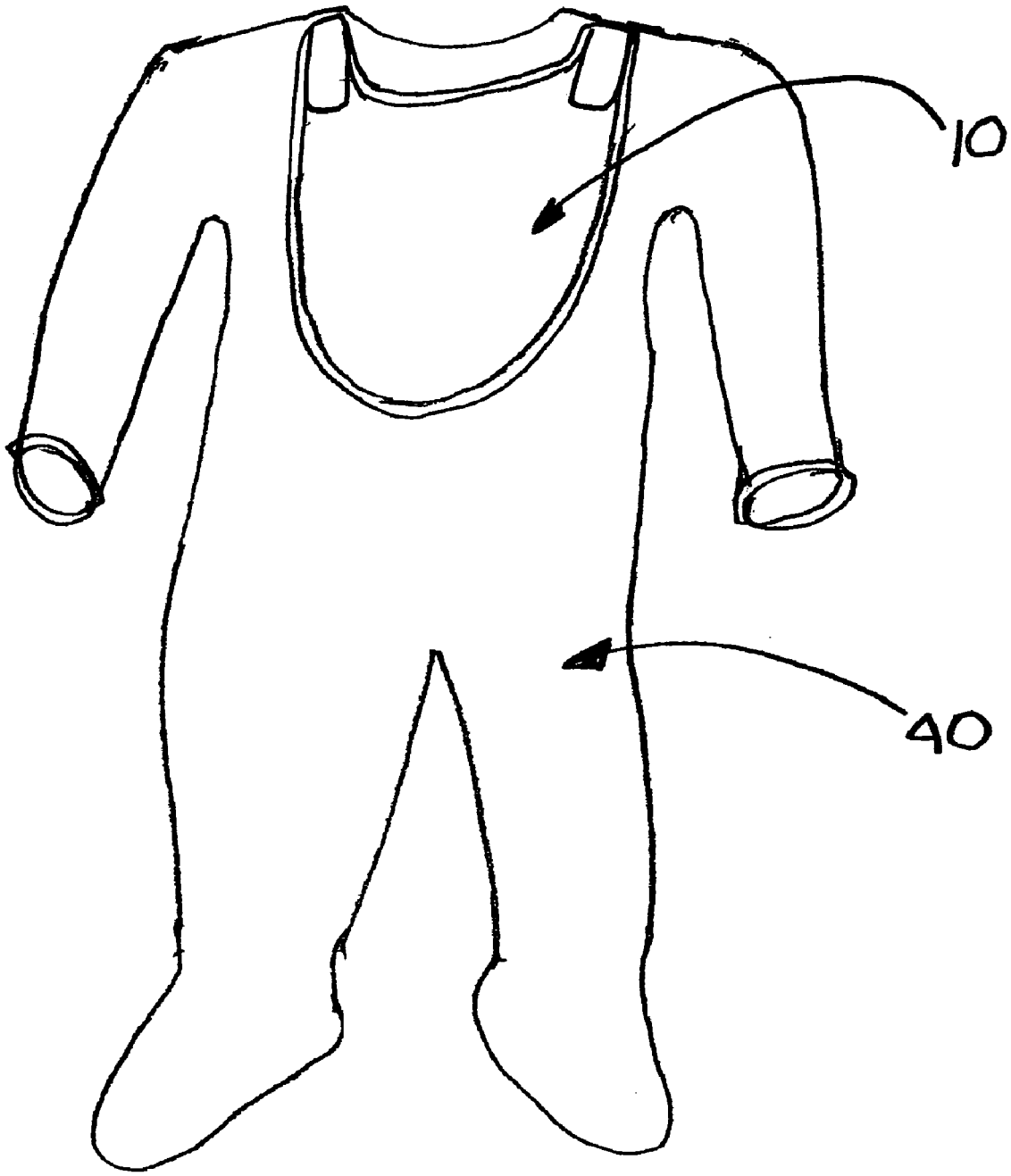

FIGS. 9 and 10 illustrate the protective bib-garment system where the garment 100 is a short sleeve short leg onsie; and garment 40 is along sleeve long leg onsie, sleeper style, respectively.

Figure 11:
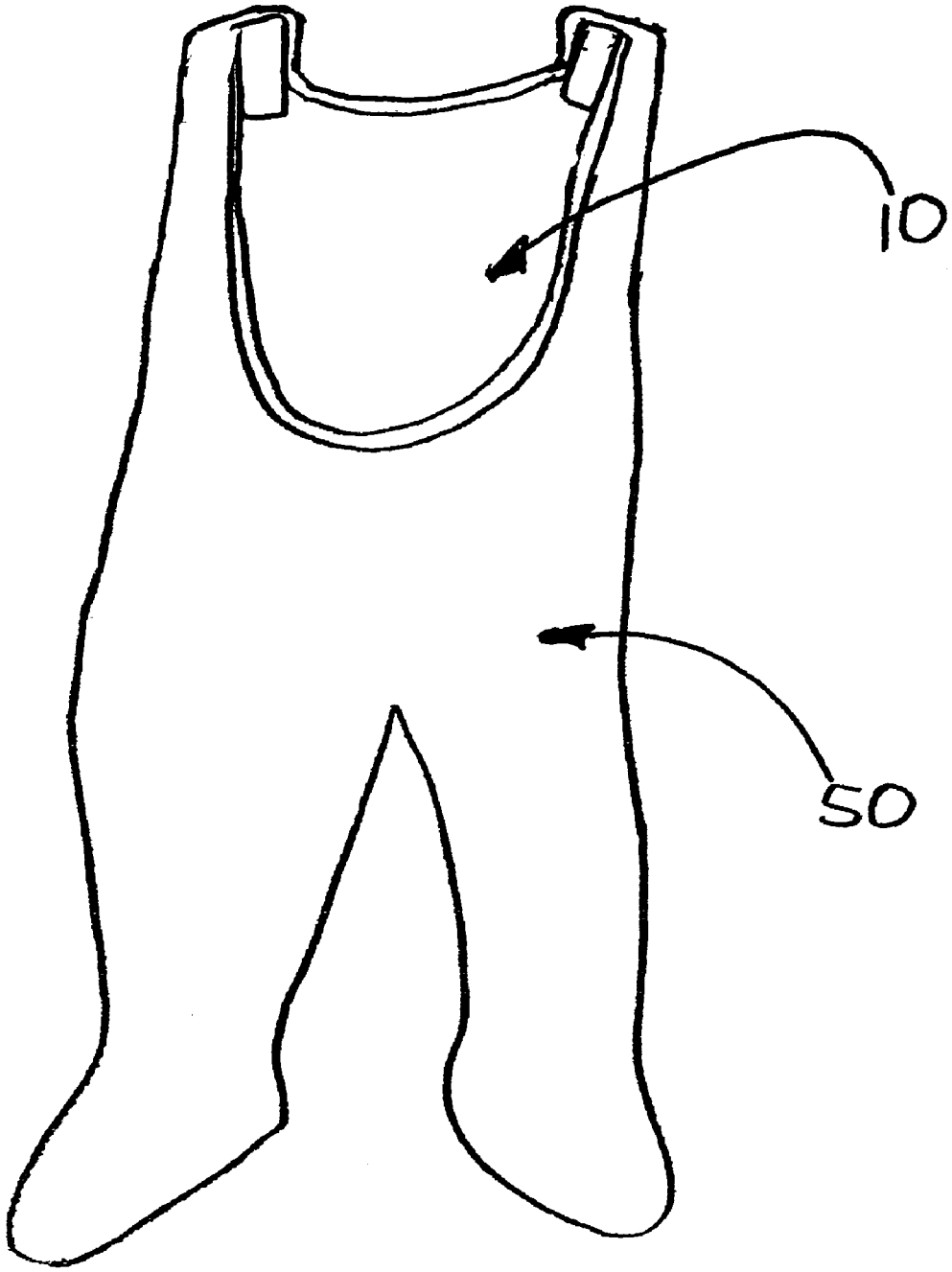
Figure 12:
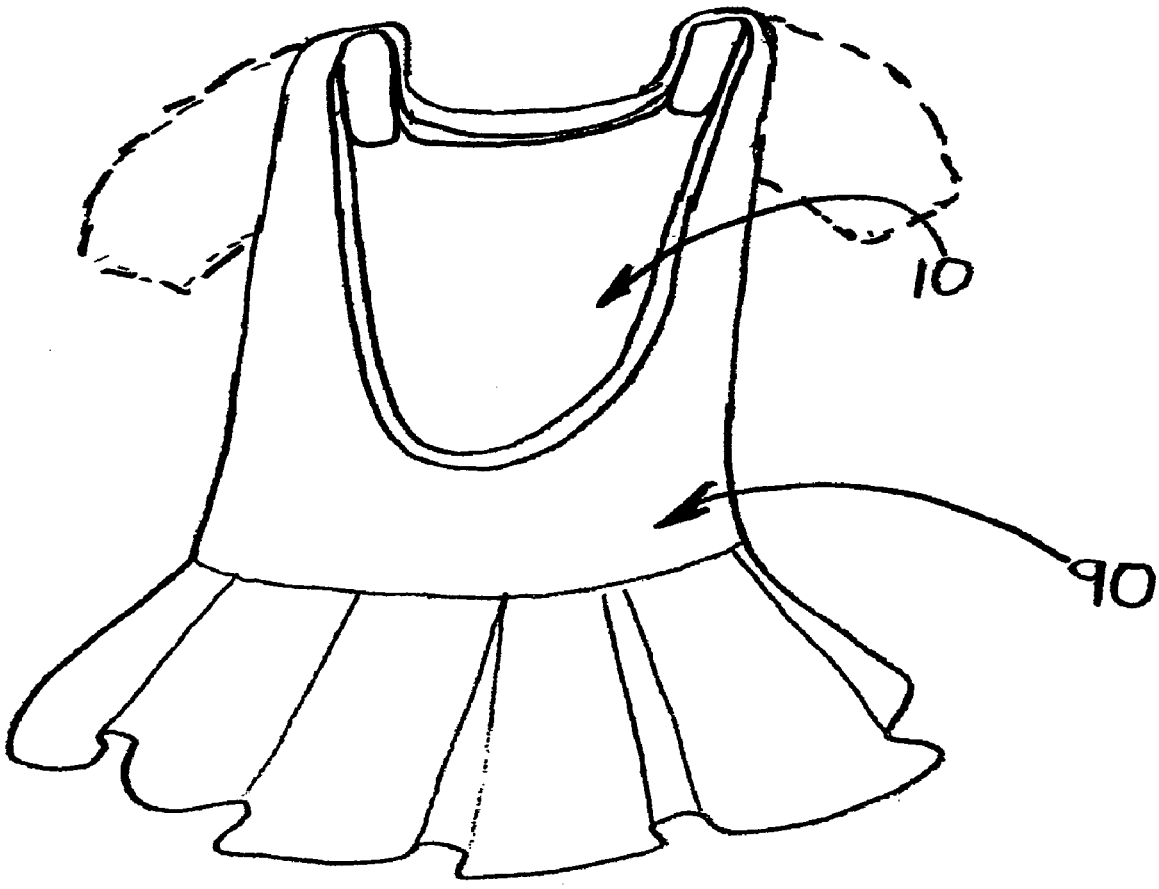

Finally in FIG. 11 the garment portion 50 is shown as an overall style jumper, while in FIG. 12 the garment portion 90 is illustrated as a halter and sleeved dress.

Note that all examples of garments, as well as others not shown here, have been made in way which allows them to be worn stylishly without the protective bib being attached. The garment-bib interface attached inside the garment reduces viewing of undergarments when protective bib is not present. Slight variations such as lightly weighting the (lower) outside edge of the bib portion can help the bib lie flat against the garment and are included within the scope of this invention.

Having described preferred embodiments of the invention with reference to the accompanying drawings, it is to be understood that the invention is not limited to these precise embodiments, and that various changes, including in the selection of the garment portion of the system, and modifications may be effected therein by one skilled in the art without departing from the scope or spirit of the invention as defined in the appended claims.

What is claimed is:

1. A protective bib-garment system, comprising:

a bib portion, having a broad protective section and two feed through straps;

each said feed through strap having an open end and a base end adjacent to said broad protective section of said bib;

a garment portion having two sets of precut openings, wherein each set of precut openings has a precut lower opening and a precut higher opening;

each set of said precut openings being positioned on said garment portion substantially at a shoulder section of said garment portion to either side of a neck opening in said garment portion;

wherein each said bib feed through strap can be fastened to itself after passing through a set of said precut lower and upper garment openings, respectively; and when fastened said bib portion remains substantially fixed in position relative to said garment portion, not rotating about a user's neck.

2. The protective bib-garment system according to claim 1 wherein said bib feed through strap is fastened to itself by a fastening system which substantially consists of a receptacle style fastener at said open end of said feed through strap and a protrusion style fastener located near said base end of said feed through strap.

3. The protective bib-garment system according to claim 1, wherein said garment portion further comprises a garment-bib interface patch on an inside surface of said garment and lying behind said precut openings.

4. The protective bib-garment system according to claim 1, wherein protection from irritation or rubbing is provided to the child/user of the garment system by not allowing feed through strap nor fasteners to come in contact with said child/user.

5. The protective bib-garment system according to claim 1, wherein all components of said bib-garment system are distant from a user's neck area reducing any chance encounter of said bib with a user's skin.

6. The protective bib-garment system according to claim 1, wherein said garment portion does not expose an undergarment at said bib attachment location, even with said bib portion removed.

7. The protective bib-garment system according to claim 1, wherein said garment portion can be worn without said bib portion.

8. The protective bib-garment system according to claim 1, wherein said garment portion is selected from the group of garments consisting of, a short sleeve shirt, a long sleeve shirt, a short sleeve, no-leg onsie, a long sleeve, no leg onsie, a short sleeve, short leg onsie, a long sleeve, long leg onsie, a sleeper style long sleeve, long leg onsie, an overall style onsie, a halter dress and a sleeved dress.

9. The protective bib-garment system according to claim 1, wherein said garment portion is a garment design which is suitable for an elderly adult or an incapacitated individual.

10. The protective bib-garment system according to claim 1, wherein said bib portion has more than one set of mating fasteners to allow adjusting length of said bib portion at time of fastening.

* * * * *